US005816603A

United States Patent [19]

Borsoi

[11] Patent Number: 5,816,603

[45] Date of Patent: Oct. 6, 1998

[54] BINDING DEVICE FOR BINDING A SHOE TO A SPORTS IMPLEMENT, PARTICULARLY TO A SNOWBOARD

[75] Inventor: Bruno Borsoi, Vittorio Veneto, Italy

[73] Assignee: Nordica S.p.A., Trevignano, Italy

[21] Appl. No.: 733,873

[22] Filed: Oct. 18, 1996

[30] Foreign Application Priority Data

Oct. 26, 1995 [IT] Italy ..... TV95A0130

[51] Int. Cl.[6] ..... A63C 9/24; A43C 11/00

[52] U.S. Cl. ..... 280/623; 280/637; 280/14.2; 36/50.1; 24/68 T

[58] Field of Search ..... 280/618, 619, 280/620, 621, 623, 624, 625, 626, 627, 632, 633, 634, 635, 637, 14.2; 36/50.1, 115; 24/70 SK, 69 SK, 68 SK, 71 SK, 68 E, 68 T, 265 BC, 265 EC, 302; 2/245, 338

[56] References Cited

U.S. PATENT DOCUMENTS

| | | | |
|---|---|---|---|
| 3,494,054 | 2/1970 | Lange | 36/50.1 |
| 3,668,791 | 6/1972 | Salzman et al. | 36/50 |
| 3,801,119 | 4/1974 | Andre | 280/620 |
| 3,931,982 | 1/1976 | Kubelka | 280/623 |
| 4,646,350 | 2/1987 | Batra | 381/51 |
| 4,999,980 | 3/1991 | McGowan | 54/23 |
| 5,324,063 | 6/1994 | Locantro | 280/637 |
| 5,401,041 | 3/1995 | Jespersen | 280/14.2 |
| 5,480,176 | 1/1996 | Sims | 280/618 |
| 5,572,774 | 11/1996 | Duren | 24/306 |

FOREIGN PATENT DOCUMENTS

| | | | |
|---|---|---|---|
| U-9113766 | 2/1992 | Germany . | |
| C-4416024 | 10/1995 | Germany . | |
| 0 705 625 | 4/1996 | Germany . | |
| 406121862 | 5/1994 | Japan | 280/14.2 |
| 0019692 | of 1900 | United Kingdom | 36/50.1 |
| 2196905 | 5/1988 | United Kingdom . | |

*Primary Examiner*—Brian L. Johnson
*Assistant Examiner*—Bridget Avery
*Attorney, Agent, or Firm*—Guido Modiano; Albert Josif

[57] ABSTRACT

A binding device, for binding a shoe on a sports implement, particularly a snowboard, is constituted by a central body having two bands of different length or arranged on different planes.

20 Claims, 3 Drawing Sheets

BINDING DEVICE FOR BINDING A SHOE TO A SPORTS IMPLEMENT, PARTICULARLY TO A SNOWBOARD

BACKGROUND OF THE INVENTION

The present invention relates to a binding device for binding a shoe to a sports implement, particularly to a snowboard.

Conventional snowboard bindings comprise at least two straps that are adapted to bind the shoe, respectively in the front region of the foot and in the foot instep region, to rigidly couple the user's foot to the snowboard and allow to correctly and optimally maneuver the sports implement.

The strap, arranged in the front region, locks the foot by pressing it downwards, thus applying a vertical force. The strap that acts at the foot instep region is generally constituted by a single element, inclined at an angle of approximately 45° with respect to the horizontal plane of the board, assuming a counterclockwise rotation as positive.

The inclination given to this last strap is necessary in order to be able to lock the foot instep, but is not ideal, because the foot instep has a double curvature with respect to the sole of the foot: a horizontal one and a vertical one.

The foot in fact has such a shape that two different and distinct curvatures occur: one at the upper part, and the other on the outer sides of the foot instep; this causes the strap to be unable to adapt to the various positions that the foot instep assumes during sports practice.

The strap also has a certain rigidity, which is necessary to ensure the fastening of the foot during sports practice and to withstand the many stresses and forces, and also has a certain softness in order to be able to adapt to the foot's curvature, this last characteristic being in contrast with the preceding ones.

Therefore, conventional straps have some drawbacks: the rigidity of the material does not ensure a perfect close fit of the strap on the shoe, especially at the double curvature that is present on the foot instep region. This entails, as a consequence of the flexing of the foot during sports activity, an uneven distribution of the pressure on the foot instep, producing unpleasant localized pressure points, especially at the longitudinal edges of the strap.

In order to obviate the above problem, the user can loosen the degree of closure of the strap, but in this manner allows the shoe to move inside the binding thereby decreasing the maneuvering sensitivity of the sports implement and therefore the user's safety.

As a partial solution to the problem of adapting the strap to the double curvature of the foot instep, a solution is known which entails providing a recess longitudinally with respect to the strap at a median region.

However, even this solution has drawbacks: when flexing the foot, the inside edges of the recess mutually interact, producing additional pressure points that overlap the localized pressure regions produced by the longitudinal edges of the straps, which continue to occur in this solution as well.

SUMMARY OF THE INVENTION

The aim of the present invention is therefore to solve the described technical problems, eliminating the drawbacks of the cited prior art, by providing a device that allows to provide more comfortable securing of the foot instep on a sports implement, particularly a snowboard binding.

Within the scope of the above aim, an important object is to provide a device that can be adapted to the shape of the user's foot instep during both static and dynamic steps of sports practice, avoiding the formation of localized pressure regions, so as to increase the level of comfort for the user.

Another important object is to provide a device that allows to increase the degree of fastening of the shoe, so as to increase maneuvering sensitivity and therefore user safety during sports practice, while maintaining a good degree of comfort.

An important object is to provide a device that can be arranged in different manner, optimally adapting itself to the inclination and curvature assumed at the foot instep as a consequence of the flexing actions imposed during sports practice.

Another object is to provide a device having low production costs that is obtained with conventional machines and equipment.

This aim, these objects, and others which will become apparent hereinafter are achieved by a binding device for binding a shoe to a sports implement, particularly a snowboard characterized in that it comprises a central body provided with at least two bands of different lenght or arranged on different planes.

BRIEF DESCRIPTION OF THE DRAWINGS

Further characteristics and advantages of the invention will become apparent from the detailed description of some particular embodiments, illustrated only by way of non-limitative example in the accompanying drawings, wherein.

DESCRIPTION OF THE PREFERRED EMBODIMENTS

Figure 1:
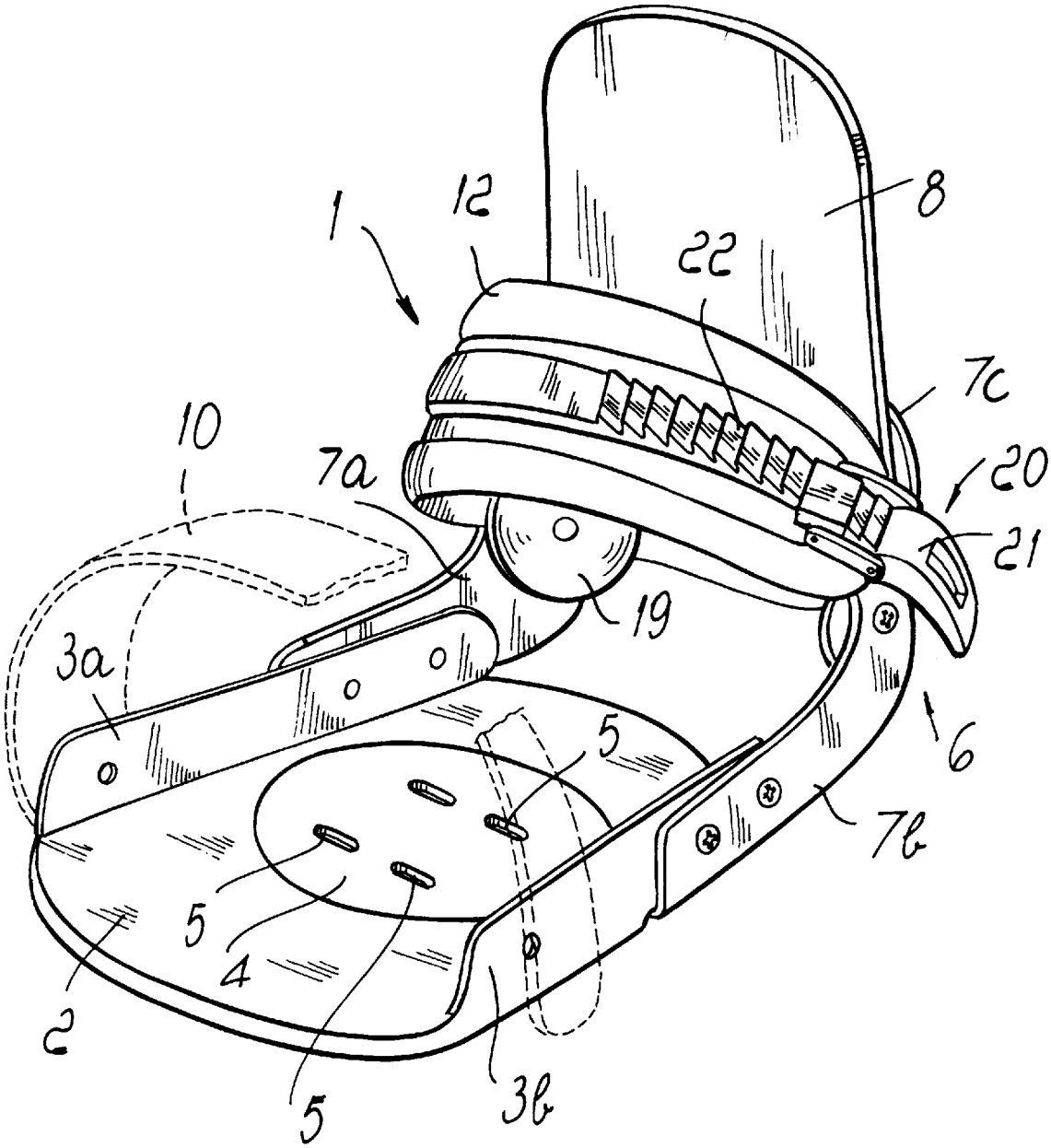
FIG. 1 is a perspective view of a snowboard binding.
Figure 2:
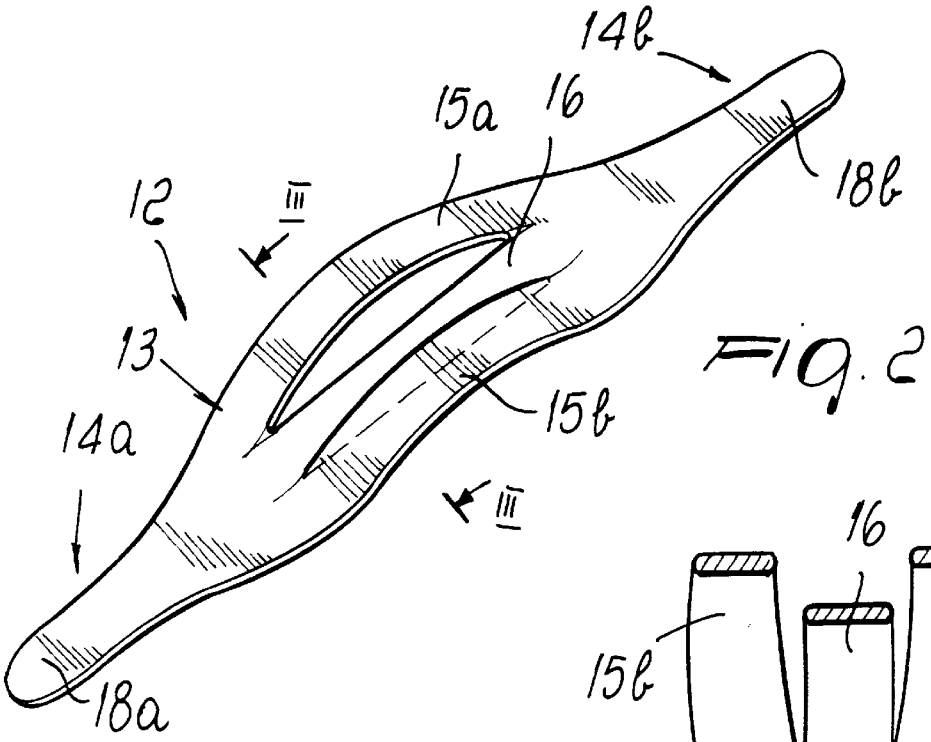
FIG. 2 is a perspective view of a binding element according to the invention.
Figure 3:
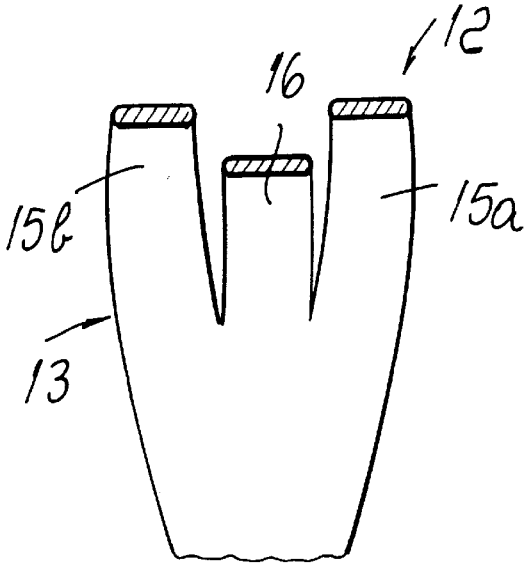
FIG. 3 is a sectional view, taken along the plane III—III of FIG. 2.

With reference to the above figures, the reference numeral 1 designates a snowboard binding constituted by a base 2 from one side of which two lateral shoulders 3*a* and 3*b* protrude at right angles.

A circular plate 4 is rotatably associated with the base 2 and is arranged in a complementarily shaped seat formed in base 2. Plate 4 has holes 5 that allow to fix it to an underlying snowboard, not shown in the figure.

The binding 1 also has a rear support 6 that is substantially U-shaped and is constituted by two wings 7*a* and 7*b* that are laterally rigidly coupled to the two lateral shoulders 3*a* and 3*b* and are joined by a connecting element 7*c* that is arranged behind and above plate 4 and is substantially as wide as plate 4.

A curved and substantially rectangular flap 8 is associated with the support 6 and protrudes above support 6. The flap is adapted to allow the rear resting of the user's foot above a first heel region 9.

The binding 1 has a front strap 10, that is shown in dashed lines in FIG. 1, and whose ends are associated with the two lateral shoulders 3*a* and 3*b* proximate to the second region 11 of the tip of the user's foot.

A binding element 12 is associated with the binding 1 and is constituted by a substantially rectangular central body 13 that has curved profile and from which a first band 14*a* and a second band 14*b*, narrower than central body 13, protrude at the ends along a substantially median axis.

In the particular illustrated embodiment, central body 13 is constituted by two first lateral bands 15*a* and 15*b* and by a second central band 16 that is shorter than the first bands 15*a* and 15*b*.

In this manner, second central band 16 has a plane of arrangement that is different from, and lower than, the plane of arrangement of the two first lateral bands 15*a* and 15*b*, allowing to recreate the curvature of third foot instep region 17.

A first seat 18*a* and a second seat 18*b*, respectively for a first coupling device 19 and for a second device 20 for temporarily fastening element 12 to binding 1, are formed at first band 14*a* and at second band 14*b* of binding element 12.

Second fastening device 20 is of the conventional type, constituted for example by a lever arm 21 that interacts with a third toothed band 22 that is associated above the element 12.

Advantageously, the point where first and second bands 14*a* and 14*b* of element 12 anchor to binding 1 is in a region between rear support 6 and flap 8 that lies below the fourth malleolar region 23. Binding element 12 is inclined with respect to the plane of plate 4 by an angle of approximately 45°, assuming a counterclockwise rotation as positive.

The operation of the binding device is as follows: the user locks the shoe to the binding 1 by fastening strap 10 and fastening binding element 12 by means of second device 20, according to the specific requirements. Binding element 12 is arranged so that second band 16 is at the foot instep region 17 and first lateral bands 15*a* and 15*b* are slightly spaced from second band 16; during foot flexing, first bands 15*a* and 15*b* can partially overlap second central band 16, allowing it to maintain the preset locking of the foot on the binding.

It has been observed that the invention thus conceived has achieved the intended aim and objects, a device having been provided which allows to provide more comfortable locking of the foot instep on a sports implement, particularly a snowboard, during both static and dynamic steps of sports practice. Initially, it is in fact possible to achieve a differentiated locking of the foot, by virtue of the tensioning of the first or second band, since the two first lateral bands 15*a* and 15*b* fasten the differently inclined adjacent regions to the foot instep region 17, which is locked by the second central band 16 that has a different length.

The overlap of the two first lateral bands on the second central band during foot flexing avoids the formation of localized pressure points, allowing the central band to maintain the locking of the foot to the implement without having to loosen the degree of closure of the fastening device.

The locking element thus allows to uniformly distribute the pressure at the foot instep region, increasing the level of comfort for the user and improving the user's maneuvering sensitivity and safety during sports practice.

The binding device according to the invention is susceptible of numerous modifications and variations, all of which are within the scope of the same inventive concept.

Figure 4:
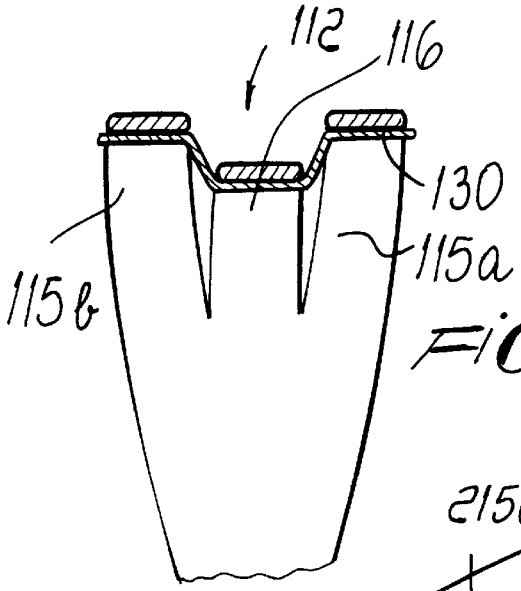
FIG. 4 is a sectional view, similar to FIG. 3, of a second embodiment of the invention.

Thus, FIG. 4 illustrates a second embodiment, in which the binding element 112 is provided with a soft covering 130 that is associated in the internal part and is constituted by a single component, which is interposed between the binding element 112 and the user's foot at the foot instep region, connecting the two first bands 115*a* and 115*b* and the second band 116 in a downward region.

This solution, too, allows to achieve the intended aim and objects.

Figure 5:
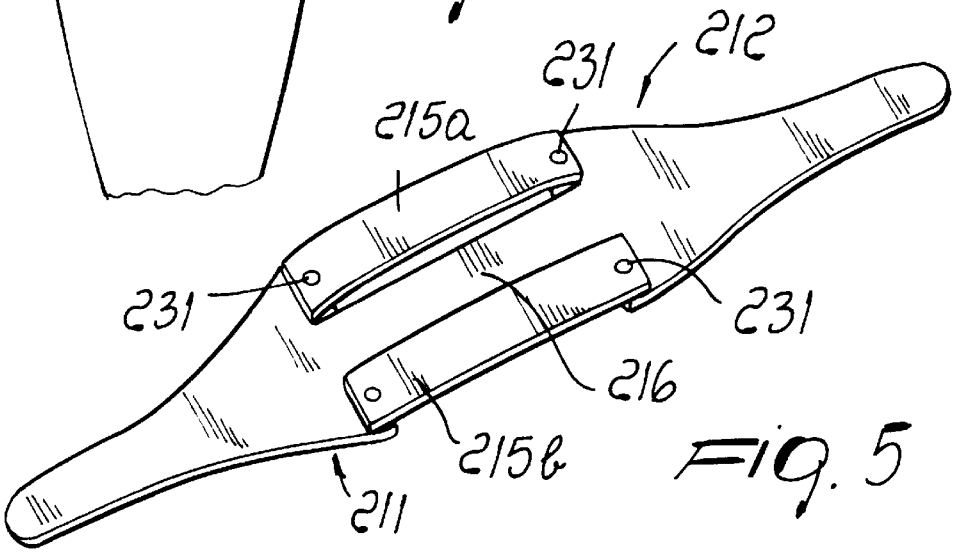
FIG. 5 is a perspective view of a third embodiment of the invention.
Figure 6:
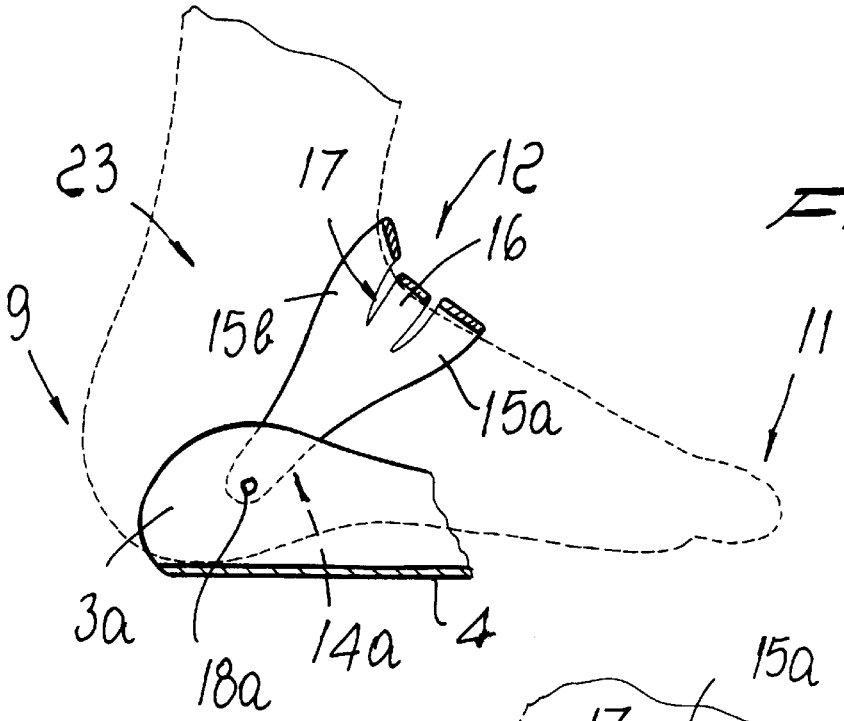
FIGS. 6, 7, and 8 are side views of a foot, respectively in the upright position, in a first inclined position, and in a second inclined position.
Figure 7:
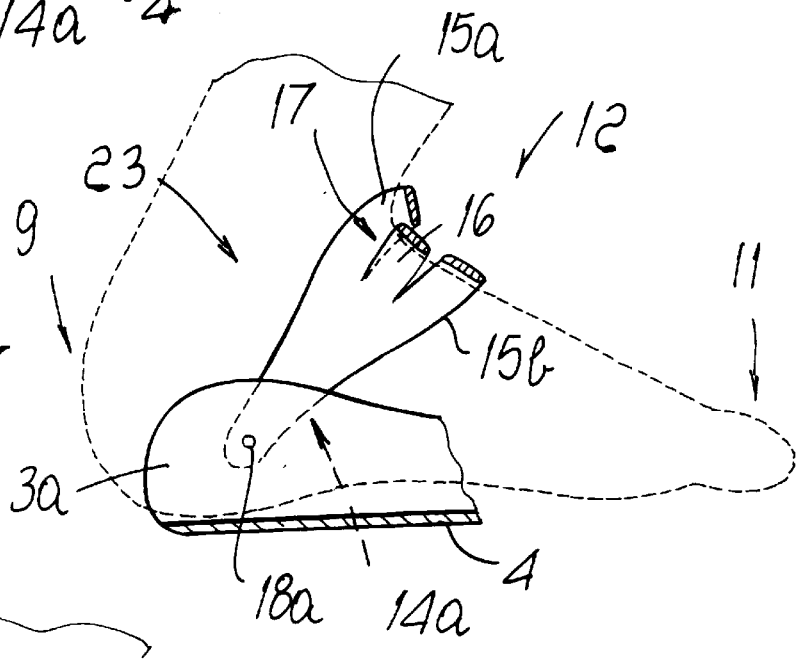
Figure 8:
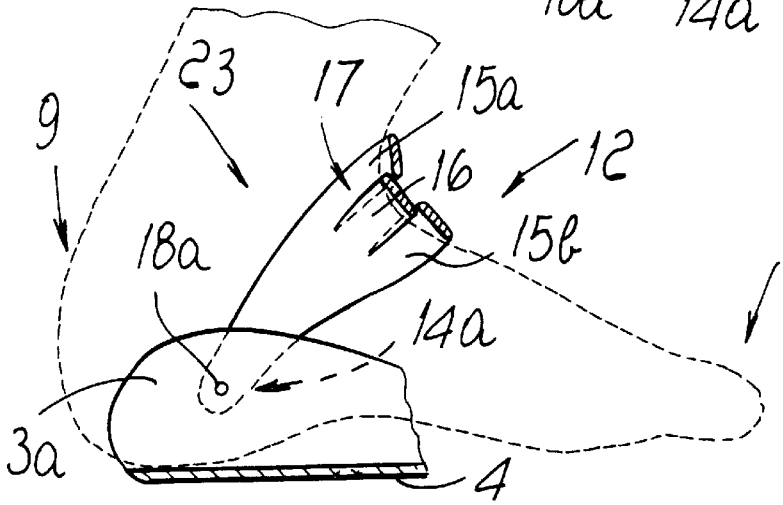

FIG. 5 illustrates another embodiment, in which the binding element 212 has an essentially H-shaped central body 211 that comprises a second central band 216.

Two first lateral bands 215*a* and 215*b* are associated with the central body 211 on the same side and are laterally adjacent to the second band 216.

The ends of each pair of first bands 215*a* and 215*b* are associated with the body 211 by means of appropriate screws or rivets 231.

The two first bands 215*a* and 215*b* are arranged at an upper level with respect to the plane that contains the second band 216.

This solution, too, allows to achieve the intended aim and objects.

The materials and the dimensions that constitute the individual components of the device may of course be the most appropriate according to the specific requirements.

What is claimed is:

1. A binding device for binding a shoe on a sports implement, comprising a central body having at least two bands of different length or arranged on different planes, a base from one side of which two lateral shoulders protrude at right angles, a strap being arranged between said shoulders, a plate for fixing to said sports implement, said plate being rotatably associated with said shoulders, two wings of a rear support being connected to said two shoulders, a flap being associated with said rear support, said central body having a substantially rectangular shape with curved profile, and a first band and a second band, narrower than said central body, protruding from ends of said central body along a substantially median axis.

2. The binding device according to claim 1, wherein said central body comprising two lateral bands and a central band, said central band being shorter than said two lateral bands and being thus arranged on a plane that lies below said two lateral bands, so as to allow to follow the curvature of a foot instep region.

3. The binding device according to claim 2, wherein a first seat and a second seat are formed at said first and second bands of said central body and accommodate respectively a first coupling device and a second device for temporarily fastening said central body to said binding device.

4. The binding device according to claim 3, wherein said first and second bands have an anchoring point located in a region that lies below the malleolar region and interposed between said rear support and said flap, said central body being inclined at an angle of 45°, assuming a counterclockwise rotation to be positive, with respect to a plane of arrangement of said plate.

5. The binding device according to claim 4, wherein a single fastening thereof entails a positioning and tensioning of said central band at said foot instep region and a simultaneous positioning and tensioning of said two lateral bands on adjacent regions having a different anatomical shape.

6. The binding device according to claim 1, further comprising a soft covering that is associated at an inner part of said central body and is constituted by a single component that interacts with the user's foot at a foot instep region, connecting two lateral bands and a central band in a downward region.

7. A binding device for binding a shoe on a sports implement, comprising a central body having at least two bands of different length or arranged on different planes, said central body comprising two lateral bands and a central band, said central band being shorter than said two lateral bands and being thus arranged on a plane that lies below said two lateral bands, so as to allow to follow the curvature of a foot instep region, a first seat and a second seat being formed at said first and second bands of said central body and accommodate respectively a first coupling device and a second device for temporarily fastening said central body to said binding device.

8. The binding device according to claim 7, comprising a base from one side of which two lateral shoulders protrude at right angles, a strap being arranged between said shoulders, a plate for fixing to said sports implement, said plate being rotatably associated with said shoulders, two wings of a rear support being connected to said two shoulders, a flap being associated with said rear support; wherein said central body has a substantially rectangular shape with curved profile, and wherein a first band and a second band, narrower than said central body, protrude from ends of said central body along a substantially median axis.

9. The binding device according to claim 7, wherein said first and second bands have an anchoring point located in a region that lies below the malleolar region and interposed between said rear support and said flap, said central body being inclined at an angle of 45°, assuming a counterclockwise rotation to be positive, with respect to the plane of arrangement of said plate.

10. The binding device according to claim 9, wherein a single fastening thereof entails a positioning and tensioning of said central band at said foot instep region and a simultaneous positioning and tensioning of said two lateral bands on adjacent regions having a different anatomical shape.

11. A binding device for binding a shoe on a sports implement, comprising a central body having at least two bands of different length or arranged on different planes, said central body having a substantially H-shape with which two lateral bands are associated on the same side, said lateral bands being arranged laterally adjacent to a second band and on a higher plane with respect to a plane that contains said central band, each one of said two lateral bands having ends associated with said central body by means of screws or rivets.

12. The binding device according to claim 11, comprising a base from one side of which two lateral shoulders protrude at right angles, a strap being arranged between said shoulders, a plate for fixing to said sports implement, said plate being rotatably associated with said shoulders, two wings of a rear support being connected to said two shoulders, a flap being associated with said rear support; wherein said central body has a substantially rectangular shape with curved profile, and wherein a first band and a second band, narrower than said central body, protrude from ends of said central body along a substantially median axis.

13. The binding device according to claim 11, wherein said central body comprising two lateral bands and a central band, said central band being shorter than said two lateral bands and being thus arranged on a plane that lies below said two lateral bands, so as to allow to follow the curvature of a foot instep region.

14. The binding device according to claim 13, wherein a first seat and a second seat are formed at said first and second bands of said central body and accommodate respectively a first coupling device and a second device for temporarily fastening said central body to said binding device.

15. The binding device according to claim 14, wherein said first and second bands have an anchoring point located in a region that lies below the malleolar region and interposed between said rear support and said flap, said central body being inclined at an angle of 45°, assuming a counterclockwise rotation to be positive, with respect to the plane of arrangement of said plate.

16. The binding device according to claim 15, wherein a single fastening thereof entails a positioning and tensioning of said central band at said foot instep region and a simultaneous positioning and tensioning of said two lateral bands on adjacent regions having a different anatomical shape.

17. A binding device for binding a shoe on a sports implement, comprising a central body having at least two bands of different length or arranged on different planes, a base from one side of which two lateral shoulders protrude at right angles, a strap being arranged between said shoulders, a plate for fixing to said sports implement, said plate being rotatably associated with said shoulders, two wings of a rear support being connected to said two shoulders, a flap being associated with said rear support, said central body comprising two lateral bands and a central band, said second band being shorter than said two lateral bands and being thus arranged on a plane that lies below said two lateral bands, so as to allow to follow the curvature of a foot instep region.

18. The binding device according to claim 17, wherein said central body has a substantially rectangular shape with curved profile, and wherein a first band and a second band, narrower than said central body, protrude from ends of said central body along a substantially median axis.

19. The binding device according to claim 17, wherein a first seat and a second seat are formed at said first and second bands of said central body and accommodate respectively a first coupling device and a second device for temporarily fastening said central body to said binding device.

20. The binding device according to claim 19, wherein said first and second bands have an anchoring point located in a region that lies below the malleolar region and interposed between said rear support and said flap, said central body being inclined at an angle of 45°, assuming a counterclockwise rotation to be positive, with respect to the plane of arrangement of said plate, and wherein a single fastening thereof entails a positioning and tensioning of said central band at said foot instep region and a simultaneous positioning and tensioning of said two lateral bands on adjacent regions having a different anatomical shape.

* * * * *